United States Patent [19]

Heikkila et al.

[11] Patent Number: 4,667,049

[45] Date of Patent: May 19, 1987

[54] METHOD OF MAKING DIALKYLAMINO-THIOXOMETHYL-THIOALKANESULFONIC ACID COMPOUNDS

[75] Inventors: Kurt E. Heikkila, Shoreview; Rodney K. Williams, St. Paul; Bruce A. Bohnen, Roseville; Russell J. Pylkki, Minneapolis, all of Minn.

[73] Assignee: ETD Technology Inc., Shoreview, Minn.

[21] Appl. No.: 834,655

[22] Filed: Feb. 27, 1986

Related U.S. Application Data

[63] Continuation of Ser. No. 667,588, Nov. 2, 1984, abandoned.

[51] Int. Cl.[4] ..... C07C 154/02

[52] U.S. Cl. ..... 558/236; 204/52.1

[58] Field of Search ..... 204/52 R, 45.1; 558/236

[56] References Cited

U.S. PATENT DOCUMENTS

| | | | |
|---|---|---|---|
| 2,891,065 | 6/1959 | Gündel | 260/455 A X |
| 3,023,215 | 2/1962 | Gündel | 260/455 A X |
| 3,122,549 | 2/1964 | Gündel | 260/455 A X |
| 3,359,297 | 12/1967 | Gündel | 260/455 A |
| 4,134,803 | 1/1979 | Eckles et al. | 204/52 R |
| 4,272,335 | 6/1981 | Combs | 204/52 R |
| 4,430,173 | 2/1984 | Boudot et al. | 204/52 R |

*Primary Examiner*—G. L. Kaplan

*Attorney, Agent, or Firm*—Merchant, Gould, Smith, Edell, Welter & Schmidt

[57] ABSTRACT

A method for the preparation of an alkali metal dialkylaminothioxomethyl-thioalkanesulfonate composition comprising reacting a monoamine with carbon disulfide to form a dithiocarbamic acid monoamine salt, reacting the salt with an alkyl sultone to form an amino thioxo methyl thioalkane sulfonate monoamine salt, and sulfonate salt with an alkali metal base to form an alkali metal salt of the amino thioxo methyl thioalkane sulfonate composition.

5 Claims, 2 Drawing Figures

H¹NMR of Active Brightner Component

3 : FROM 3.61 TO 3.43 PPM
INTEGRAL= 152.69
5 : FROM 3.43 TO 3.29 PPM
INTEGRAL= 235.69
2 : FROM 3.07 TO 2.90 PPM
INTEGRAL= 97.28
2 : FROM 2.22 TO 2.00 PPM
INTEGRAL= 97.36
3.378
3.484
3.401
3.358
3.020
2.996
2.968
2.184
2.129
2.102
2.077
2.054
PPM
3.5
3.0
2.5
2.0

METHOD OF MAKING DIALKYLAMINO-THIOXOMETHYL-THIOALKANESULFONIC ACID COMPOUNDS

This is a continuation of application Ser. No. 667,588 filed Nov. 2, 1984 and now abandoned.

FIELD OF THE INVENTION

The invention relates to the manufacture of a dialkylamino-thioxomethyl-thioalkanesulfonate composition, having the general formula:

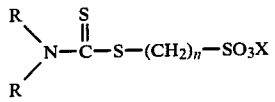

wherein n is an integer of about 1 to 6, X is hydrogen or an alkali metal cation, and R is generally alkyl. More particularly, the invention relates to the preparation of dialkylamino-thioxomethyl-thioalkanesulfonate compositions of substantial purity that can be used in aqueous acid metal electroplating plating media as a brightener composition. The method of forming the brightener composition has been found to be particularly useful in forming brightener additive compositions substantially free of contaminants, such as non-volatile impurities and reaction by-products formed from highly reactive organic species, that can substantially reduce the quality of the metal deposit.

BACKGROUND OF THE INVENTION

Dialkylamino-thioxomethyl-thioalkanesulfonate compositions have been used for many years in methods for the electrodeposition of metal. During the electrodeposition of metal deposits in the absence of organic brightener and leveler additives, metal deposits often form with a crystalline, matte or burned finish, can vary substantially in thickness from place to place on the deposit, can have pinholes, can have poor elongation properties, and can be high in tensile strength. Such a metal plate can be undesirable from an aesthetic point of view, and can be undesirable in many technological end uses. One major end use of the metal deposit is on a copper plated printed circuit board. The copper deposit on a circuit board should be bright, shiny, lustrous, uniform in thickness, have substantial elongation properties, and modest tensile strength. Bright, shiny boards are easily wetted by solder compositions providing for rapid and efficient connection of electrical components to the printed circuit board. Uniform continuous coatings of copper that have acceptable elongation properties and tensile strength can be resistant to the formation of hairline cracks, which can form during the manufacture and use of the electronic device, that can result in the interruption of the electrical current and in the failure of the electronic device to operate.

One known method for the preparation of the dialkylamino-thioxomethyl-thioalkanesulfonate involves the reaction of dialkyl-dithiocarbamyl chloride with an omega mercaptoalkanesulfonate. The desired sulfonic acid composition is generated at low yields in the reaction along with hydrochloric acid and non-electroactive reaction products. In order to improve yields, an organic base has been suggested in the art to reduce the effect of water on the reaction and to scavenge a hydrochloric acid by-product. However, we have found that an organic base, such as pyridine, did not substantially improve yields of the desired sulfonic acid product.

Another known method involves a simultaneous reaction of an amine, carbon disulfide and an alkane sultone in the presence of alkali metal base to form the desired product. Still another reaction sequence involves the reaction of the amine and carbondisulfide in the presence of sodium hydroxide prior to reaction with the sultone to form the desired product. These preparatory schemes can generate inorganic, nonvolatile by-products and impurities. British Pat. No. 764,613 discloses this procedure.

Accordingly, a substantial need exists for a method for the preparation of a dialkylamino-thioxomethyl-thioalkenesulfonate brightener compositions of high purity at high yield substantially free of substantial quantities of inactive or harmful by-products and avoids generating substantial quantities of nonvolatile impurities which can interfere in electroplating.

BRIEF DESCRIPTION OF THE INVENTION

We have found that the dialkylamino-thioxomethylth composition (also known as dialkyldithiocarbamyl-omega-sulfoniumalkanesulfonate composition) of this invention can be made in a process that avoids the use of high energy reactants, hydrochloric acid scavenging organic bases, and the formation of undesirable inactive or nonvolatile by-products and impurities. The method of the invention comprises reacting a dialkyl monoamine with carbon disulfide to form a dialkyldithiocarbamate amine salt according to the following reaction formulae:

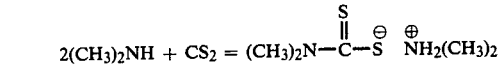

The amine salt of the dialkyl dithiocarbamic acid can be reacted with a cyclic alkane sultone to form the dialkylamino-thioxomethyl-thioalkanesulfonate amine salt according to the following reaction formula:

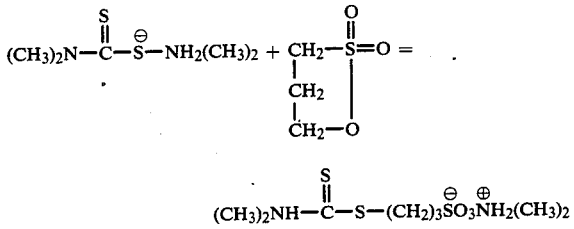

The reactions to this point avoid the use of high energy reactants such as carbamyl chlorides, the use of inorganic bases such as sodium hydroxide, generates no inactive byproducts and no nonvolatile reaction impurities. The dialkylamino-thioxomethyl-thioalkanesulfonate amine salt is reacted with an alkali metal base in order to replace the amine in the salt with an alkali metal ion, liberate free amine into solution, and generate the sodium salt of the dialkyl amino thioxomethyl thioalkane sulfonate. At reaction temperatures common in the preparation of the dialkyl amino dithiooxomethylthio sulfonate sodium salt brightener composition, a substantial portion of the liberated dialkyl amine is volatilized and substantially completely removed from the solution in the reaction as shown in the following reaction sequence:

$$(CH_3)_2N\overset{\overset{\displaystyle S}{\|}}{C}-S(CH_2)_3\overset{\ominus}{S}O_3\overset{\oplus}{N}H_2(CH_3)_2 + NaOH =$$

$$(CH_3)_2N\overset{\overset{\displaystyle S}{\|}}{C}S(CH_2)_3\overset{\ominus}{S}O_3\overset{\oplus}{N}a + NH(CH_3)_2 + H_2O$$

The reaction product is substantially free of inactive reaction by-products and nonovolatile inorganic components. The product can be prepared at a 90% or greater stoichiometric yield with greater than 97% purity.

DETAILED DESCRIPTION OF THE INVENTION

Figure 1:
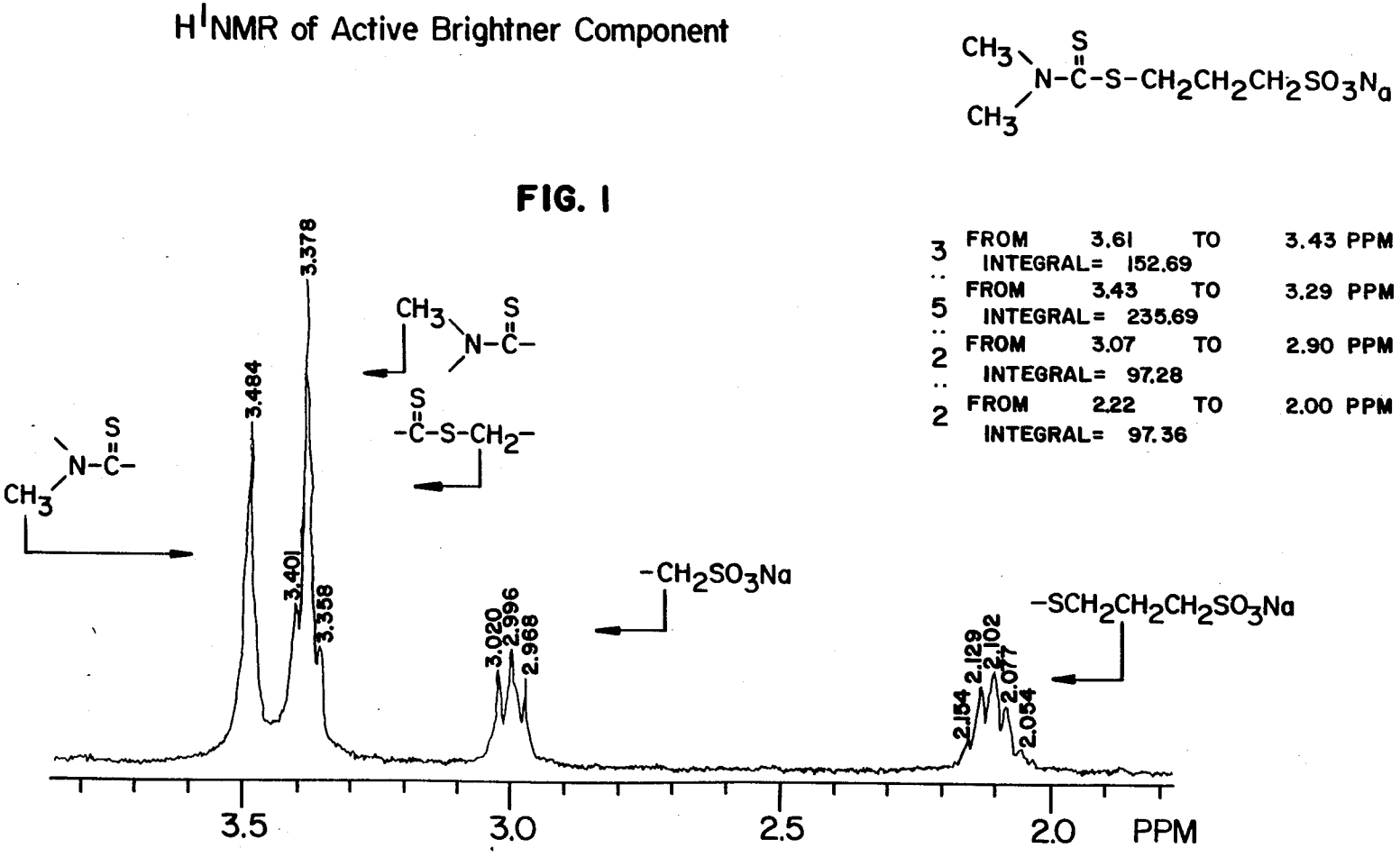
Figure 2:
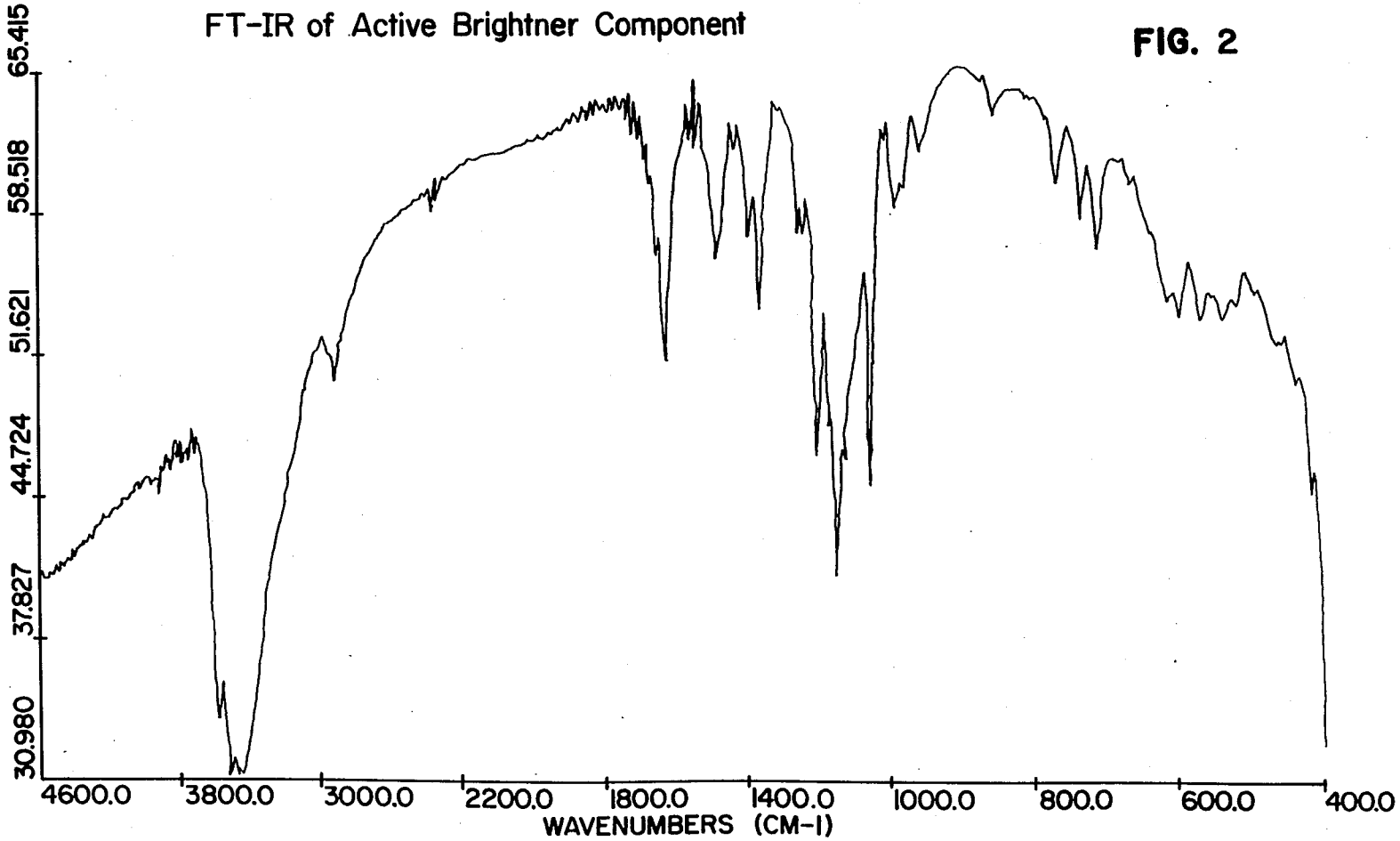

In somewhat greater detail, the method of preparing the brightener composition of the invention resulting in high yields and high purity involves in a first step the reaction of a dialkyl monoamine with carbon disulfide.

Dialkylamines and Carbon Disulfide

Amines that can be used in the first step of the reaction include amines having the following formula:

R—NH—R wherein each R is independently selected from the aliphatic group consisting of n-alkyl, isoalkyl, tertiary alkyl, and cycloalkyl groups. Typical examples of useful groups include methyl, ethyl, propyl, isopropyl, butyl, isobutyl, tertiary butyl, amyl, hexyl, 2-ethylhexyl, cyclohexyl, methylcyclohexyl, cyclopropyl, etc. Each R can also be independantly aromatic, unsaturated, or mixed aliphatic and aromatic in character and can be independantly selected from the group of hydrocarbon groups such as phenyl, benzyl, xylyl, cyclohexenyl, 4-methyl-pentenyl and others. Preferred amines include lower dialkyl monoamines such as dimethylamine, diethylamine, methylethylamine, dipropylamine, methylhexylamine ethylisopropylamine, dihexylamine and others having R groups independently selected from $C_{1-6}$ alkyl groups. Carbon disulfide is a well known industrial reagent.

Alkanesultone

In the second step of the reaction forming the brightener composition of the invention, the dialkyl dithiocarbamate amine salt is reacted with a cyclic alkanesultone to produce the dialkylamino-thioxomethylthioalkanesulfonate amine salt. Sultones that can be used in the reaction to form the brightener composition include compositions of the following formula:

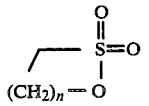

wherein n can be an integer of 1 or more, preferably for ease of reaction can be an integer from 1 to 6, and most preferably for high yield and highly active electroplating additive can be an integer of 2 to 4. Specific examples of the preferred alkane sultone compositions in this invention include 1,2-ethanesultone, 1,3-propanesultone, 1,4-butanesultone, 1,5-pentanesultone, and 1,6-hexanesultone or mixtures thereof.

Base

The thus-formed dialkylamino-thioxomethyl-thioalkanesulfonate amine salt can be reacted with an alkali metal base displacing the amine from the salt and replacing the amine salt with the alkali metal ion. Alkali metal bases useful in this reaction step include well known alkali metal bases. Preferred alkali metal bases for use in this reaction are the alkali metal hydroxides including sodium hydroxide, potassium hydroxide, and mixtures thereof.

Solvent

The synthetic method of this invention can be run in any compatible polar reaction solvent in which the organic components are soluble including N,N-dimethyl formamide, dimethyl sulfoxide, lower alkanols, tetrahydrofuran, etc. and mixtures thereof. Preferred reaction solvents include lower alkanols such as methanol, ethanol, isopropanol, n-butanol, t-butanol, and other oxygen containing solvents such as ethyl ether, methylisobutyl ketone. However, we have found that the reaction product can be made at highest purity and at the optimum yield through the use of isopropyl alcohol. We have found that the reaction product is insoluble in isopropyl alcohol and at the end of the reaction, as the reaction mixture cools, the desired reaction product crystallizes and precipitates in the reaction solvent. Upon filtration, the filter cake comprises substantially pure reaction product while the filtrate contains remaining nonvolatilized amine, unreacted alkali metal base, and unreacted sultone and other byproducts and impurities. With the use of the other lower alkanols, substantially pure product can be prepared but somewhat more reaction product can be lost in the reaction solvent.

Reaction Parameters

In performing the reaction,. in a first step carbon disulfide is commonly reacted with about 1 to 2.5 moles of a dialkylamine in the reaction solvent. Either reactant can be added to the other reactant in any sequence alone or in combination with a portion of the reactant solvent. However, preferably a solution of the dialkyl amine is placed in the reaction vessel in a portion of the reaction solvent and a solution of carbon disulfide in the balance of the reaction solvent is added slowly to the amine compound. The addition of reactants are commonly controlled so that heat liberated in the exothermic reaction does not drive the reaction temperature to an unacceptably high level. Commonly the addition rate should be maintained such that the reaction temperature does not exceed about 30°–40° C. Carbon disulfide is highly volatile and controlling the reaction temperature can aid in reducing the volatility of carbon disulfide, increasing the effective concentration of carbon disulfide in the reaction mixture, and driving the reaction to completion. The product of the reaction between the dialkylamine and carbon disulfide should be substantially pure dialkyl dithiocarbamate dialkyl amine salt.

The alkane sultone is reacted with the dialkyldithiocarbamate-dialkylamine salt to form the dialkylamino-thioxomethyl-thioalkanesulfonate dialkylamine salt. The alkyl sultone can be added directly to the reaction mixture in solid or particulate form or can be added to the reaction mixture, dissolved or suspended in the reaction solvent. Approximately equimolar amounts of the sultone are added to the sulfonate amine salt. After the addition of the sultone initiates the reaction to form the sulfonate, an exotherm is typically seen which drives the temperature to about 50° C. or more.

After the reaction between the dialkyl dithicarbamyl amine salt and the alkyl sultone is complete, forming the dialkyl-amino-thioxomethyl-thioalkane sulfonate amine salt, it is reacted with an alkali metal base to displace the amine with an alkali metal cation liberating the amine and forming the alkali metal salt of the sulfonate. Typically a slight excess of a stoichiometric amount of alkali metal base is added to the reaction product in order to completely liberate amine and to form the alkali metal salt in substantially complete yield. The reaction mixture can be maintained at an elevated temperature, about 50° to 60° C. or higher in order to volatilize the majority of the liberated dialkyl amine prior to isolation of the desired reaction product. Typically the reaction product is crystallized from the reaction solvent and washed with cold solvent to remove the last traces of amine, sultone and other reactants.

Use

The reaction product of the invented method can be used as a brightener additive in strong acid plating systems. Typically strong acid plating systems include in an aqueous solution a strong acid such as sulfuric acid, a source of electroreducible metal such as copper sulfate, and other components. The brightener additive composition of this invention can be used in such acid plating systems at a concentration of about 0.1 to about 1,000 parts of the brightener composition, preferably the brightener additive is added at a concentration of about 1 to 800 parts of brightener additive per million parts of the total plating medium. Most preferably, for reasons of economy and best brightener performance, the composition of the invention can be added to the electroplating bath medium at a concentration of about 2 to about 750 parts of the brightener composition per million parts of the plating bath medium.

The brightener of this invention typically can be sold in concentrate form as an aqueous solution containing the brightener additive at a concentration of 0.2 to 20 grams of brightener per liter of concentrate, a leveler additive composition at a concentration of 0.01 to 5 grams of leveler per liter of concentrate, and one or more polyalkylene oxide compounds, at a concentration of about 0.1 to 5 grams of total polyalkylene compound per liter of concentrate. A preferred leveler is disclosed in Applicant's copending application, U.S. Ser. No. 667,539 (now abandoned). A preferred polyalkylene oxide component is disclosed in Applicant's copending application, U.S. Ser. No. 667,541 (now abandoned). The additive package typically is added to acidic metal plating baths at sufficient amounts to result in a concentration of the brightener additive in the plating medium of about 0.01 to 1,000 parts per million parts of plating medium. Most preferably for reasons of high quality plating at lowest cost, the brightener is used at a concentration of 0.01 to 100 parts of brightener per million parts of plating medium. The leveler additive can be used in the plating medium at a concentration of about 0.005 to 100 parts, preferably 0.01 to 100 parts, of leveler additive per million parts of plating medium. Preferably alkylene oxide compounds of this invention can be used in a plating medium at a concentration of about 0.01 to 500, preferably 0.05 to 250 parts per million parts of plating medium. Most preferably for reasons of effective plating with no break-in, the polyalkylene oxide surfactants selected for use in the plating bath medium preferably have a relationship between the lower molecular weight components of the surfactant and the higher molecular weight components of the surfactants such that at least 10% of the surfactant comprises a portion having a molecular weight of less than 5,700. Preferably at least 20% of the surfactant has a portion having a molecular weight less than 5,700.

The additive concentrate can also be used to replenish the plating media during extended periods of the medium use. About 0.10 to 2 mL of the concentrate can be added to the medium per each amp-hour (0.10–2 mL $Amp^{-1}\ hr^{-1}$) of use.

The above described invention can be further illustrated and understood by reference to the following Examples which include a best mode.

EXAMPLE I

Into a 100 milliliter glass ignition tube equipped with screw threads was placed 12.25 grams of a 40 wt-% aqueous solution of dimethyl amine (4.9 grams 0.043 mole) and 15 milliliters of isopropyl alcohol. Into the amine solution was added, drop-wise over a 10-minute time period in order to maintain the reaction temperature at less than 30° C., a solution 2.74 grams of carbon disulfide (0.036 moles) in 15 milliliters of isopropyl alcohol. At the end of the addition of the carbon disulfide solution, an additional 50 milliliters of isopropyl alcohol was added to the reaction mixture followed by a suspension of 4.40 grams (0.036 mole) of 1,3-propane sultone in 15 milliliters of isopropyl alcohol. The tube was capped. The addition of the sultone increased the temperature of the reaction mixture to 50° C. and the exotherm continued for about 20 minutes. At the end of the exotherm, the reaction product in solvent was removed from the tube and applied to a high pressure liquid chromatography column which indicated an overall yield of 49% based upon the carbon disulfide.

EXAMPLE II

Example was repeated except that 6.9 gm. (0.061 mole) of dimethylamine was used instead of 4.9 gm (0.043 mole) of dimethylamine in the first step and after the reaction with the 1,3-propane sultone the reaction product was contacted with 10 milliliters of a 3.6 molar aqueous solution of sodium hydroxide. Yield of product was 100%.

EXAMPLE III

Into a 5 liter, three-neck round bottom flask (equipped with a motor driven stirring mechanism, a dropping funnel, and a thermometer) placed in means equipped with cooling service water, was placed 239.93 grams of 40 wt-% aqueous solution of dimethyl amine (95.97 gm., 2.13 moles) and 520 milliliters isopropyl alcohol. Stirring was initiated and into the stirred reaction mixture, 95.14 grams of carbon disulfide (1.25 moles) in 520 milliliters of isopropyl alcohol was added drop-wise over a 10 minute period in order to maintain the reaction temperature at less than 30° C. At the end of the addition of the carbon disulfide reaction was permitted to go to completion (about 15 minutes) at that time an additional 50 milliliters of isopropyl alcohol was added to the reaction mixture followed by 152.78 grams (1.25 moles) of 1,3-propane sultone in 15 milliliters of isopropyl alcohol. At the addition of the sultone the temperature of the reaction mixture increased to 50° C.

and an exotherm was generated for about 20 minutes. At the end of the exotherm the reaction product in solvent was removed from the flask and filtered. The cake was washed with cold methyl alcohol. 157 milligrams of the filter cake product in 100 milliliters of water was applied to an HPLC machine showing essentially 100% purity. Overall yield was 91.7%.

TABLE I

Elemental Analysis of Product of Example III

| Element | Percent Composition | Raw Equivalent (%)/AT WT | Found | Theoretical Formula |
|---|---|---|---|---|
| C | 26.56 | 2.1146 | 5.9 | 6 |
| H | 4.50 | 4.4554 | 12.4 | 12 |
| N | 5.05 | 0.3605 | 1.0 | 1 |
| S | 33.51 | 1.0452 | 2.9 | 3 |
| Na | 9.16 | 0.3984 | 1.1 | 1 |
| O | 17.30 | 1.0813 | 3.0 | 3 |
| | | $C_6H_{12}NS_3O_3Na$ | | |

FIG. I is a proton nuclear magnetic resonance spectrum of the product of Example III. FIG. II is a Fouriertransform infrared spectrum of the compound of Example III.

Testing of Copper Deposits for Improved Characteristics

As discussed above, copper deposits should have a tensile strength, and an elongation at break sufficient to resist the harmful effects of heat generated by active electronic circuits. In order to test the effect of the brightener composition of the invention on metallurgical properties, copper foils were made using an electroplating medium containing 22 M $H_2SO_4$, 0.38 M $CuSO_4$, 50 ppm $Cl^-$, 0.6 ppm brightener of this invention, 175 ppm polyethylene oxide and a varying concentration of a leveler composition. The foils were prepared in a plating cell having an internal media circulation means designed to continually circulate the plating media over the boards with a high concentration of copper at the working cathode surface. These foils were tested for tensile strength and elongation at break with IPC test method 2.4.18 (ASTM-E-345), the results of which are shown in Tables II and III.

TABLE II

Tensile Strength (lb/in$^2$ × 1000)

| Relative Concentration of Leveler | Brightener* + Leveler $\bar{X}$ | % RSD |
|---|---|---|
| Horizontal Sample | | |
| 0 | 43.6 | 4.0 |
| ¼ | 43.4 | 0.3 |
| ½ | 45.0 | 2.6 |
| ¾ | 46.6 | 2.3 |
| 1** | 44.8 | 4.0 |
| 2 | 51.5 | 3.0 |
| Vertical Sample | | |
| 0 | 44.9 | 7.0 |
| ¼ | 45.2 | 4.0 |
| ½ | 47.0 | 2.0 |
| ¾ | 49.2 | — |

TABLE II-continued

Tensile Strength (lb/in$^2$ × 1000)

| Relative Concentration of Leveler | Brightener* + Leveler $\bar{X}$ | % RSD |
|---|---|---|
| 1 | 47.6 | 2.0 |
| 2 | 57.3 | 2.3 |

*Dimethylamino-thioxomethyl-thiopropanesulfonate sodium.
**0.07 ppm.

TABLE III

% Elongation at Break

| Relative Concentration of Leveler | EL-112 ACB F-21 $\bar{X}$ | % RSD |
|---|---|---|
| Horizontal Sample | | |
| 0 | 10.1 | 12 |
| ¼ | 11.6 | 12 |
| ½ | 9.9 | 10 |
| ¾ | 9.2 | — |
| 1 | 11.6 | 22 |
| 2 | 9.8 | 13 |
| Vertical Sample | | |
| 0 | 8.7 | 53 |
| ¼ | 12.0 | 28 |
| ½ | 9.8 | 11 |
| ¾ | 9.3 | 18 |
| 1 | 11.0 | 19 |
| 2 | 6.0 | 48 |

An examination of Tables II and III shows that the additive can be used with a leveler additive to provide a useful, bright, smooth uniform metal deposit.

The above description and Examples provide a basis for understanding Applicants' invention. However, since many variations and embodiments of the invention can be made, the invention resides in the claims hereinafter appended.

I claim:

1. A method for the preparation of an improved, more pure dialkylamino-thioxomethyl-thioalkanesulfonate composition which comprises the steps of:
   (a) reacting a dialkyl monoamine compound with carbon disulfide in sufficient amount to form a dialkyl dithiocarbamate dialkylamine salt;
   (b) reacting the dialkyl dithiocarbamate dialkylamine salt with an alkyl sultone to form a dialkylamine salt of a dialkylamino-thioxomethyl-thioalkanesulfonate; and
   (c) reacting the dialkylamine salt of the dialkylamino-thioxomethyl-thioalkanesulfonate with an alkali metal base at a sufficient temperature (1) to form an alkali metal salt of the dialkylamino-thioxomethyl-thioalkane sulfonic acid substantially free of nonvolatile reaction by-products and impurities; and (2) to volatilize the liberated monoamine.

2. The method of claim 1 wherein each alkyl group of the dialkyl amine is independently selected from methyl, ethyl, propyl, isopropyl, butyl, isobutyl, t-butyl, amyl or hexyl.

3. The method of claim 1 wherein the alkyl sultone comprises 1,3-propane sultone.

4. The method of claim 1 wherein the alkali metal base comprises an alkali metal hydroxide.

5. The method of claim 4 wherein the alkali metal hydroxide comprises sodium hydroxide.

* * * * *

UNITED STATES PATENT AND TRADEMARK OFFICE

CERTIFICATE OF CORRECTION

PATENT NO. : 4,667,049

DATED : May 19, 1987

INVENTOR(S) : KURT E. HEIKKILA et al

It is certified that error appears in the above-identified patent and that said Letters Patent is hereby corrected as shown below:

Column 2, lines 14 and 15, for "thioalkenesulfonate" read --thioalkanesulfonate--.
Column 2, line 23, for "thioxomethylth" read --thioxomethylthioalkanesulfonate--.
Column 3, line 10, for "nonovolatile" read --nonvolatile--.
Column 5, line 5, for "dithicarbamyl" read --dithiocarbamyl--.
Column 6, line 62, for "disulfide reaction" read --disulfide the reaction--.

Signed and Sealed this

Fifteenth Day of September, 1987

*Attest:*

DONALD J. QUIGG

*Attesting Officer*

*Commissioner of Patents and Trademarks*